US008491261B2

(12) United States Patent
Lin

(10) Patent No.: US 8,491,261 B2
(45) Date of Patent: Jul. 23, 2013

(54) BLOWER

(75) Inventor: Hsin-Chen Lin, Taoyuan Hsien (TW)

(73) Assignee: Delta Electronics, Inc., Kuei San, Taoyuan Hsien (TW)

( * ) Notice: Subject to any disclaimer, the term of this patent is extended or adjusted under 35 U.S.C. 154(b) by 846 days.

(21) Appl. No.: 12/195,825

(22) Filed: Aug. 21, 2008

(65) Prior Publication Data

US 2009/0053053 A1 Feb. 26, 2009

(30) Foreign Application Priority Data

Aug. 24, 2007 (TW) ..... 96131434 A

(51) Int. Cl.
*F04D 29/54* (2006.01)
*F04D 29/42* (2006.01)

(52) U.S. Cl.
USPC ..... 415/206; 415/224

(58) Field of Classification Search
USPC ..... 415/206, 224, 212.1, 97, 205, 102
See application file for complete search history.

(56) References Cited

U.S. PATENT DOCUMENTS

| | | | | |
|---|---|---|---|---|
| 2002/0056453 | A1* | 5/2002 | Klopp et al. | 128/204.18 |
| 2004/0191060 | A1* | 9/2004 | Chiu et al. | 415/206 |
| 2005/0260073 | A1* | 11/2005 | Hsu et al. | 415/199.6 |
| 2007/0128052 | A1* | 6/2007 | Moriya et al. | 417/354 |
| 2011/0058938 | A1* | 3/2011 | Chen | 415/206 |

* cited by examiner

*Primary Examiner* — Caridad Everhart
(74) *Attorney, Agent, or Firm* — Muncy, Geissler, Olds & Lowe, PLLC

(57) ABSTRACT

A blower includes an impeller and a housing. The housing has an accommodating portion, a throat portion and a concave portion. The impeller is disposed within the housing and rotates via the shaft. A first axial line and a second axial line are perpendicular to each other, and both intersect at a position where the shaft is located to divide the housing into four regions. Both of the throat portion and the concave portion are disposed adjacent to the outlet and disposed in the first region.

18 Claims, 11 Drawing Sheets

BLOWER

CROSS REFERENCE TO RELATED APPLICATIONS

This Non-provisional application claims priority under 35 U.S.C. §119(a) on Patent Application No(s). 096131434, filed in Taiwan, Republic of China on Aug. 24, 2007, the entire contents of which are hereby incorporated by reference.

BACKGROUND OF THE INVENTION

1. Field of Invention

The present invention relates to a fan and in particular to a blower.

2. Related Art

With the development of electronic devices, the demands for heat dissipation also increase. Therefore, the heat dissipation technology has become an important issue of the computer industry. Since fans have the advantages of low costs and mature development, fans are often used for heat dissipation.

As shown in FIG. 1, a conventional blower 1 includes an impeller 11 and a housing 12. The housing 12 has an accommodating portion 121 where the impeller 11 is disposed. Moreover, the housing 12 has an outlet h1 and a throat portion T1. The throat portion T1 is adjacent to the outlet h1. When the blower 1 operates, the airflow flows out from the outlet h1. The throat T1 is used to prevent the airflow from being brought back into the accommodating portion 121 by the impeller 11 and thus reducing the air flux.

Please refer FIGS. 1 to 2B. FIG. 2A shows the fast Fourier transform (FFT) frequency spectrum demonstrating prominence ratio of a conventional blower 1. FIG. 2B shows the FFT frequency spectrum demonstrating the noise volume of the conventional blower 1. As shown in FIG. 2B, the conventional blower 1 produces a frequency peak P2 in the frequency spectrum demonstrating the noise is ultra-high when the impeller rotates at a particular speed (frequency). The highest noise volume at the frequency peak P2 is about 25 decibel (dB). In FIG. 2A, there is a prominence ratio peak P1 corresponding to the frequency peak P2 in FIG. 2B. The prominence ratio peak P1 of the conventional blower is about 5.24 dB. Therefore, although the use of the throat portion T1 can prevent air from flowing back into the accommodating portion 121, the continuous impact of the air flux on the throat portion T1 produces a rapid change in pressure. This results in the problem of high noise peak value P2 and high prominence ratio peak value P1 in the conventional blower 1.

SUMMARY OF THE INVENTION

In view of the foregoing, the present invention is to provide a blower that can prevent too much frequency noise from the impeller and reduce the contrast ratio.

To achieve the above, the present invention discloses a blower including an impeller and a housing. The housing has an outlet, a throat portion and a concave portion, and the impeller is disposed within the housing. The impeller rotates via the shaft. A first axial line and a second axial line are perpendicular to each other, and both intersect at a position where the shaft is located to divide the housing into four regions. Both of the throat portion and the concave portion are disposed adjacent to the outlet and disposed in the first region of the four regions.

As mentioned above, the blower is provided with a concave portion on the bottom of the housing near the throat portion of the housing. This design increases the air flowing space in the vicinity of the throat portion and guides the airflow direction, thereby reducing the pressure in the nearby region of the throat portion due to continuous impact of the airflow. The airflow field and pressure gradient in the nearby region of the throat portion are improved so that the blower of the present invention can be free from large noise and reduce the prominence ratio when the impeller rotates at a particular speed (frequency).

BRIEF DESCRIPTION OF THE DRAWINGS

The present invention will become more fully understood from the detailed description and accompanying drawings, which are given for illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
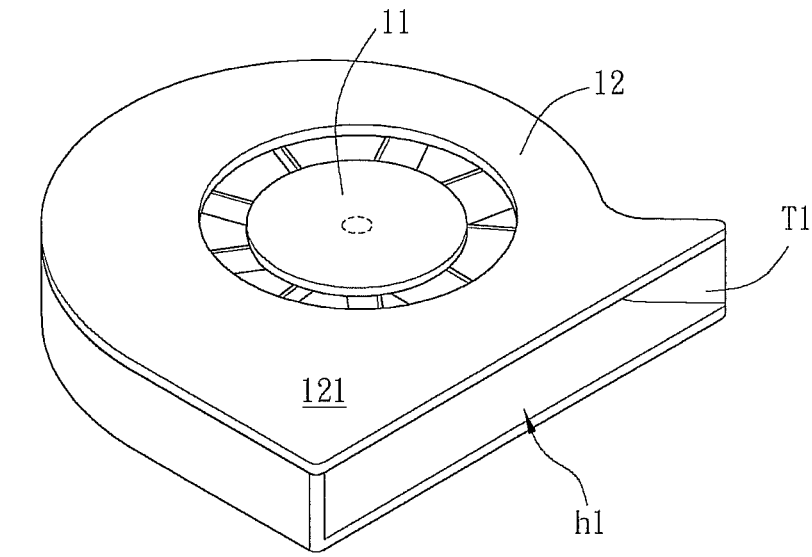
FIG. 1 (PRIOR ART)
FIG. 1 is a schematic illustration of the conventional blower.
Figure 2A:
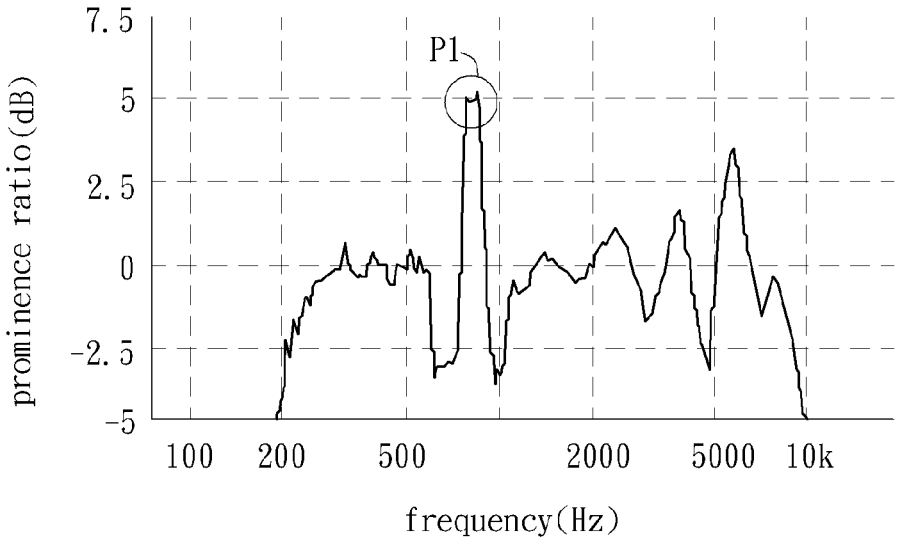
FIG. 2A (PRIOR ART)
FIG. 2A shows the FFT frequency spectrum demonstrating prominence ratio of the conventional blower.
Figure 2B:
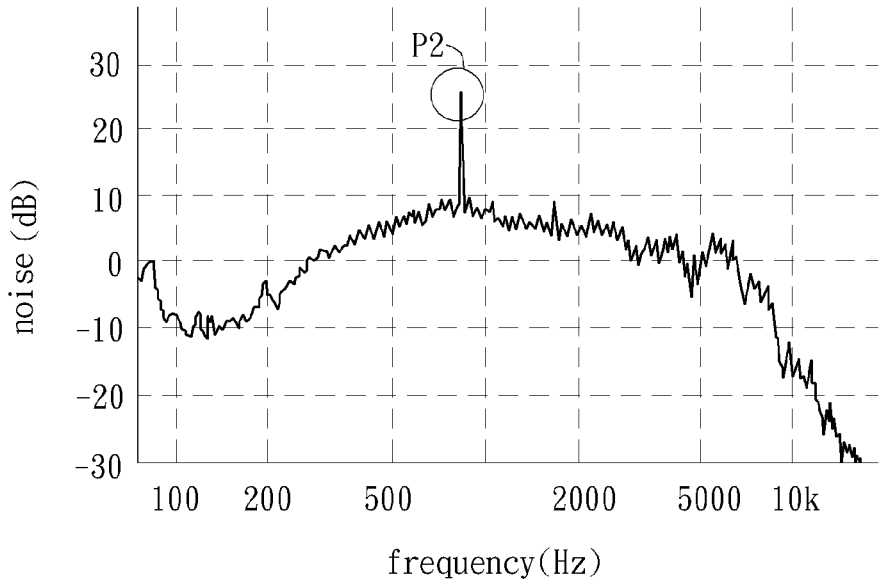
FIG. 2B (PRIOR ART)
FIG. 2B shows the FFT frequency spectrum demonstrating the noise volume of the conventional blower.
Figure 3A:
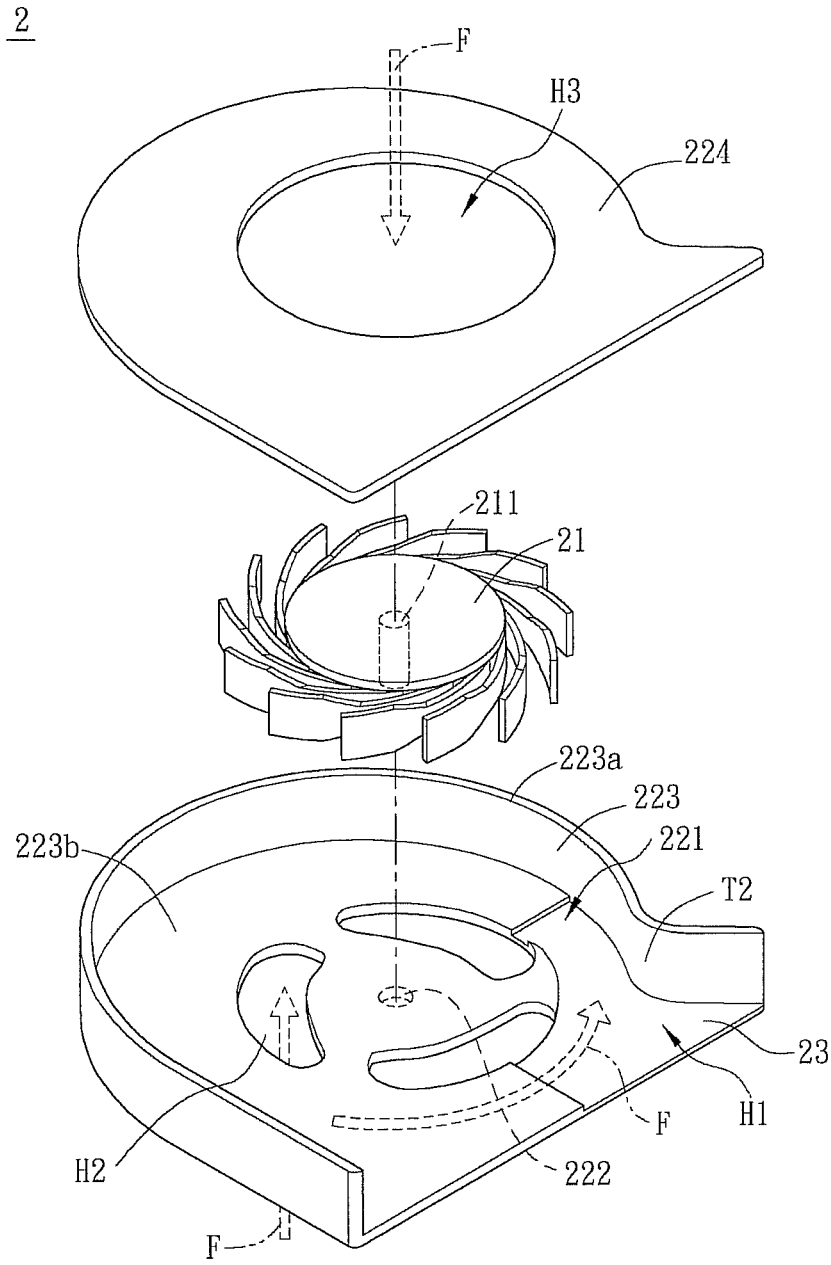
FIG. 3A is a exploded view of a blower according to a first embodiment of the present invention.

As shown in FIG. 3A, a blower 2 according to a first embodiment of the present invention includes an impeller 21 and a housing 223.

The impeller 21 has a shaft 211. The housing 223 has an accommodating portion 221, a central point 222, a throat portion T2, and a concave portion 23. Moreover, the blower 2 has a cover 224, and an outlet H1. The outlet H1 is formed when the cover 224 is connected with the housing 223, and the throat portion T2 and the concave portion 23 are disposed adjacent to the outlet H1. The cover 224 has a first inlet H3, and the first inlet H3 is disposed at the cover 224.

The housing 223 has a sidewall 223*a*, a bottom 223*b*, and a second inlet H2. The sidewall 223*a* is disposed around the bottom 223*b*. There is at least one second inlet H2 disposed at the bottom 223*b* of the housing 223. Moreover, in this embodiment, there are at least two second inlets H2 disposed at the bottom 223*b* of the housing 223 and surround around the position where the shaft 211 is located.

Figure 3B:
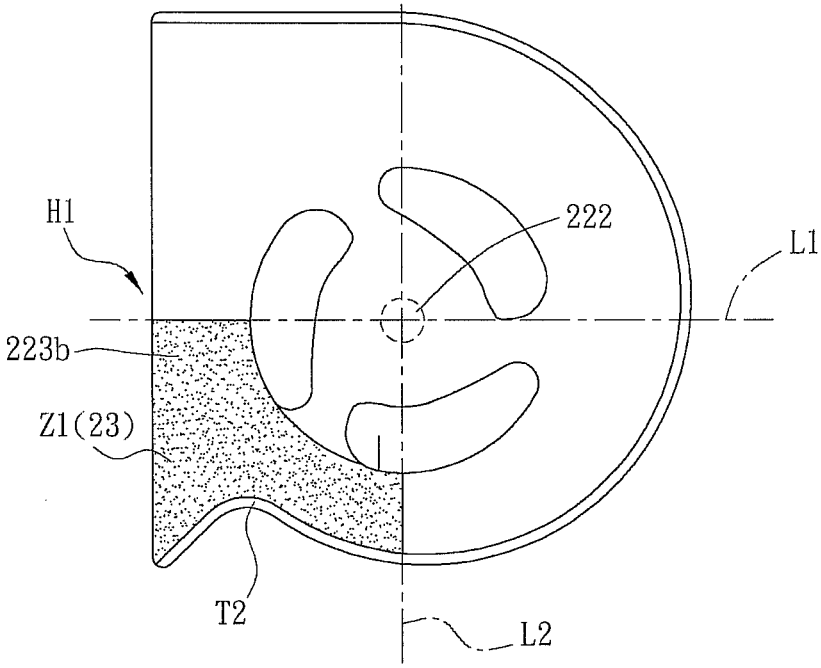
FIG. 3B is a top view of a first sub-housing of the blower according to the first embodiment of the present invention.

The impeller 21 having a shaft 211 is disposed within the housing 223. The impeller 21 rotates via the shaft 211. Please refer to FIG. 3B for a top view of the housing 223. A first axial line L1 and a second axial line L2 are perpendicular to each other, and both intersect at a position where the shaft 211 is located to divide the housing 223 into four regions. Both of the throat portion T2 and the concave portion 23 are disposed adjacent to the outlet H1 and disposed in the first region Z1.

Therefore, after the impeller 21 starts rotating, the airflow F enters from the first inlet H3 and the second inlet H2. It is then driven by the impeller's rotation (e.g., in the counter-clockwise direction) and leave the housing 223 via the outlet H1. The direction of the airflow F at the outlet is perpendicular to an airflow direction at the first inlet H3.

However, some of the airflow F still rotates with the impeller 21 due to inertia. This part of airflow has an impact on the throat portion T2 that is supposed to prevent the interference of air backflow and produces a rapid change of the pressure in the throat portion T2. Consequently, it uses the concave portion 23 to increase the flowing space of the airflow F near the throat portion T2 in this embodiment. The airflow F thus flows along the extension direction of the concave portion 23, reducing the impact on the throat portion T2.

The concave portion 23 can increase the flowing space of the airflow F near the throat portion T2 and reduce the pressure on the throat portion T2 imposed by the airflow F. This can decrease the variation of the airflow field and pressure gradient in the nearby region of the throat portion T2.

Figure 4A:
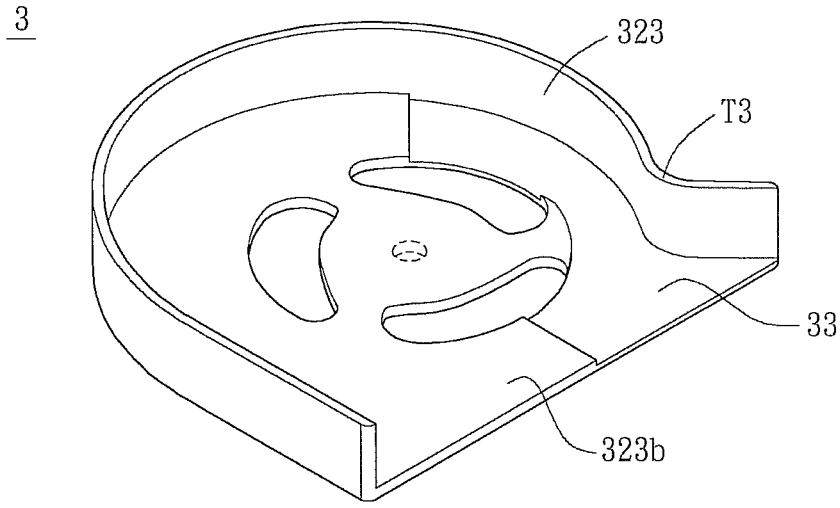
FIG. 4A is a schematic illustration of a first sub-housing of a blower according to a second embodiment of the present invention.
Figure 4B:
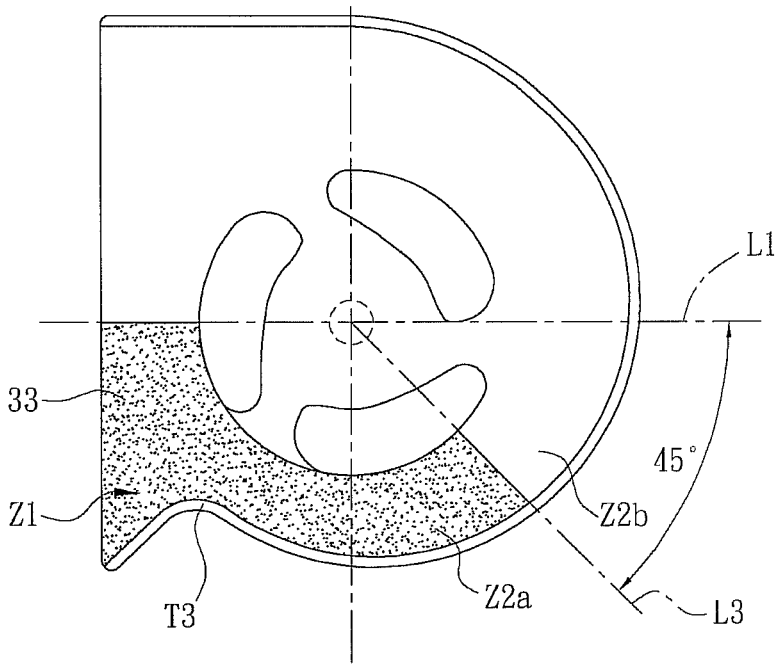
FIG. 4B is a top view of the first sub-housing in FIG. 4A.

FIG. 4A is a schematic illustration of a housing 323 of a blower 3 according to a second embodiment of the present invention, and FIG. 4B is a top view of the housing 323 in FIG. 4A. Please refer to FIGS. 4A and 4B, the difference between the current embodiment and the previous one is that the housing 323 of the blower 3 in this embodiment further includes a third axial line L3 rotating at a 45-degree angle from the first axial line L1, thereby dividing a second region Z2 adjacent to the first region Z1 into a first sub-region Z2*a* and a second sub-region Z2*b*. The concave portion 33 is further extended from the first region Z1 to at least one part of the bottom 323*b* of the first sub-region Z2*a*. In this embodiment, the concave portion 33 includes both the bottom 323*b* of the first region Z1 and the bottom 323*b* of the first sub-region Z2*a*.

Through the extension of the concave portion 33, the flowing space of airflow in the nearby region of the throat portion T3 is extended inward. This can also achieve the effect of reducing the local pressure at the throat portion T3.

Figure 5:
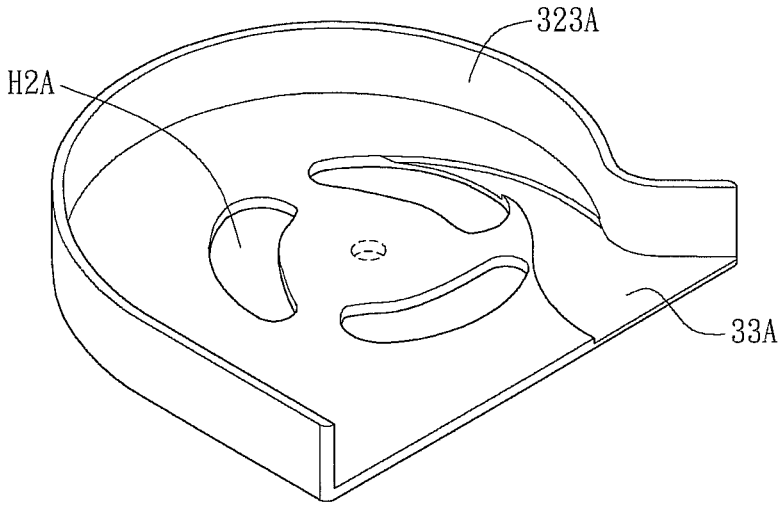
FIG. 5 is a schematic illustration of a first sub-housing of a blower according to a third embodiment of the present invention.

FIG. 5 is a schematic illustration of a housing 323A of a blower according to a third embodiment of the present invention. As shown in FIG. 5, the difference between this embodiment and the above-mentioned embodiment is that the concave portion 33A has a streamline shape. This can enhance the airflow guidance effect of the concave portion 33A. In this embodiment, the concave portion 33A and the second inlet H2A are connected. However, the concave portion 33A and the second inlet H2A can also be disconnected (not shown in the figures).

Figure 6A:
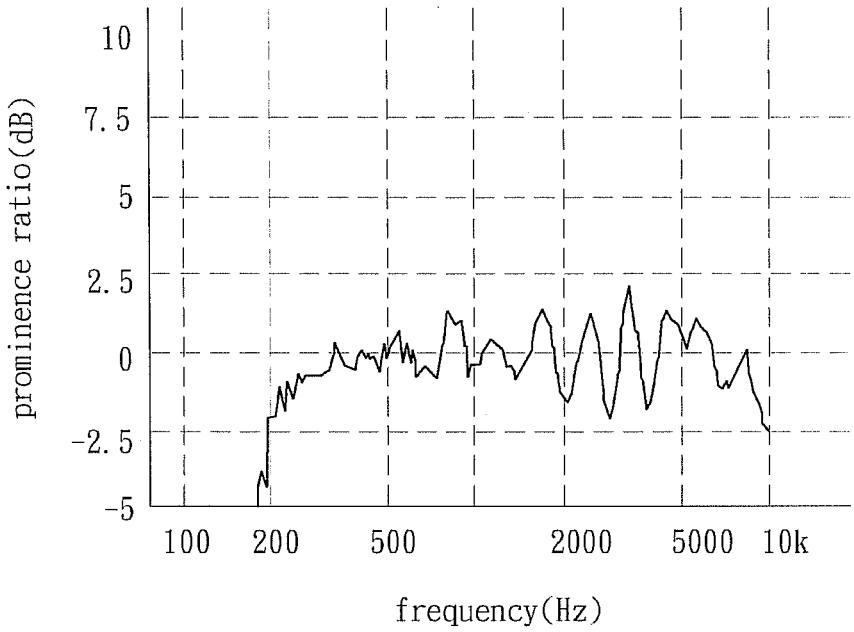
FIG. 6A shows the FFT frequency spectrum demonstrating prominence ratio of the blower with the first sub-housing of FIG. 5.
Figure 6B:
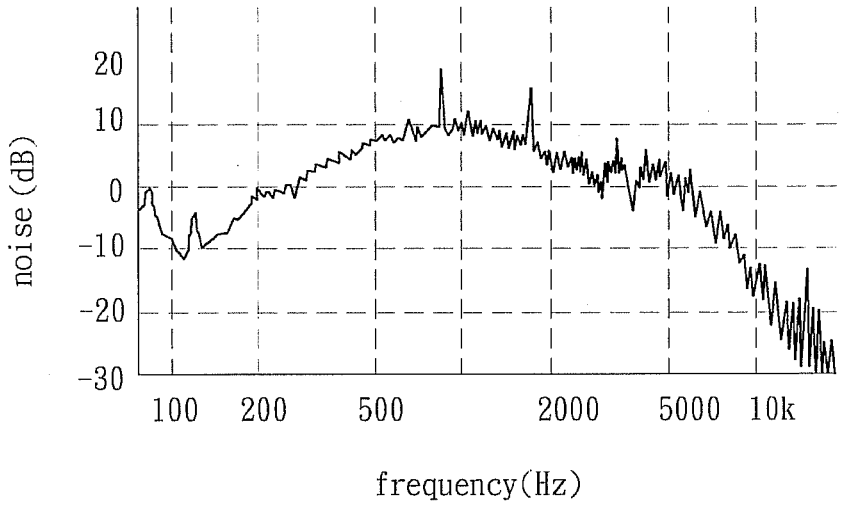
FIG. 6B shows the FFT frequency spectrum demonstrating the noise volume of the blower with the first sub-housing of FIG. 5.

FIG. 6A shows the FFT frequency spectrum demonstrating prominence ratio of the blower with the first sub-housing of FIG. 5, and FIG. 6B shows the FFT frequency spectrum demonstrating the noise volume of the blower with the first sub-housing of FIG. 5. As shown in FIGS. 6A and 6B, the highest prominence ratio value of the blower in this embodiment is only about 2.15 dB. The FFT frequency spectrum demonstrates the noise produced when the impeller rotates is also kept below 20 dB.

Figure 7A:
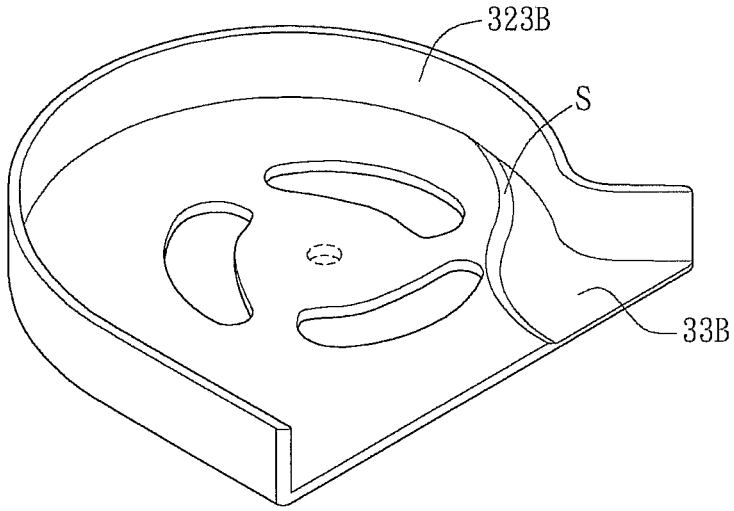
FIG. 7A is a schematic illustration of a first sub-housing of a blower in a fourth embodiment of the present invention.

FIG. 7A is a schematic illustration of a housing 323B of the blower in the fourth embodiment of the present invention. The difference between this embodiment and the previous embodiments is in that not only does the concave portion 33B have a streamline shape, there is also a slant surface S. In addition to enhancing the airflow guidance of the concave portion 33B, the influence of the concave portion 33B on the original properties of the blower is also reduced because the pressure distribution in the accommodating portion (compare with FIG. 3A) is different. This is due to the fact that the concave portion 33B is not connected with the inlet (the slant surface and the inlet are disconnected) in this embodiment.

Figure 7B:
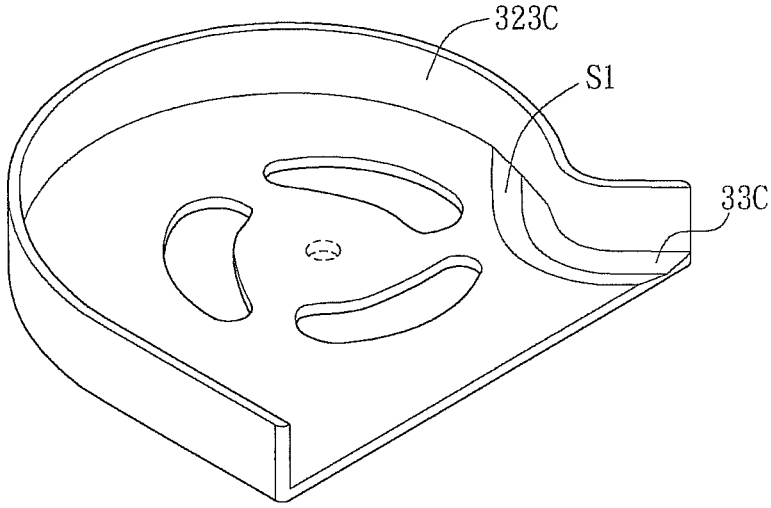
FIGS. 7B and 7C show different aspects of a first sub-housing of a blower according to a fifth embodiment of the present invention.
Figure 7C:
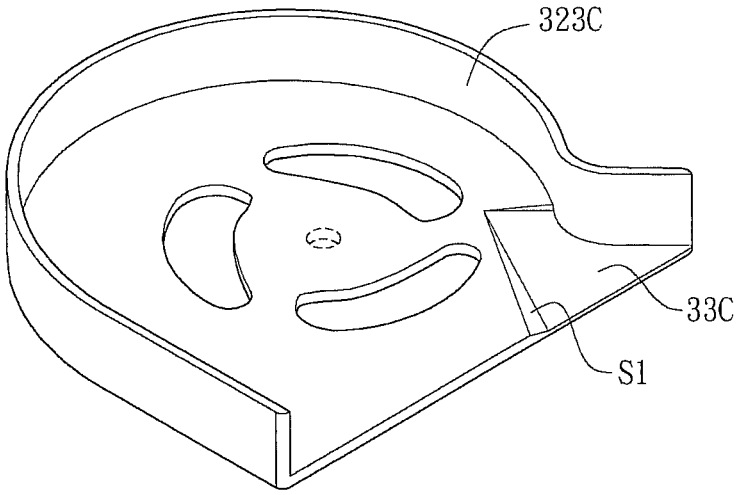

FIGS. 7B and 7C show different aspects of a housing 323C of a blower according to a fifth embodiment of the present invention. Referring to FIGS. 7B and 7C, the concave portion 33C has a slant surface S1. Its shape can have different designs.

Figure 8:
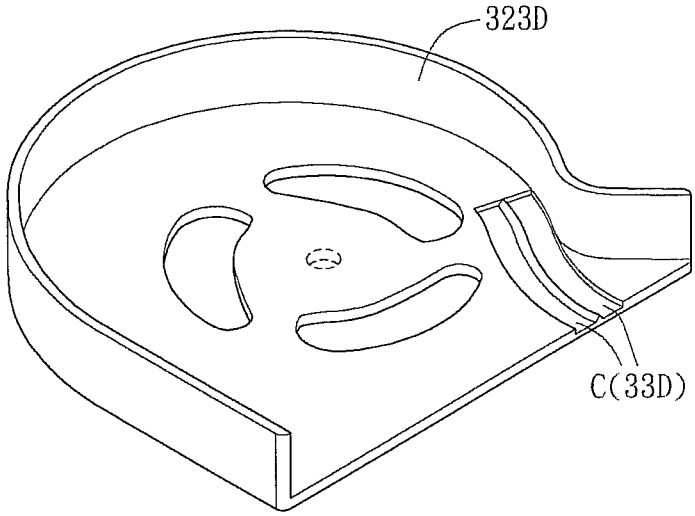
FIG. 8 is a schematic illustration of a first sub-housing of a blower according to a sixth embodiment of the present invention.

FIG. 8 is a schematic illustration of a housing 323D of a blower according to a sixth embodiment of the present invention. Referring to FIG. 8, the sixth embodiment is different from the previous embodiments that the concave portion 33D further has several concave sub-portions C. This embodiment uses two concave sub-portions C as an example. The use of different concave sub-potions C can increase the air flowing space.

To be noted, each of the concave portions is disposed on the bottom 223*b* of the housing 223 in FIG. 3A. They can also be disposed in the region near the throat portion T2 of the cover 224 in FIG. 3A and achieve the same effects.

Figure 9A:
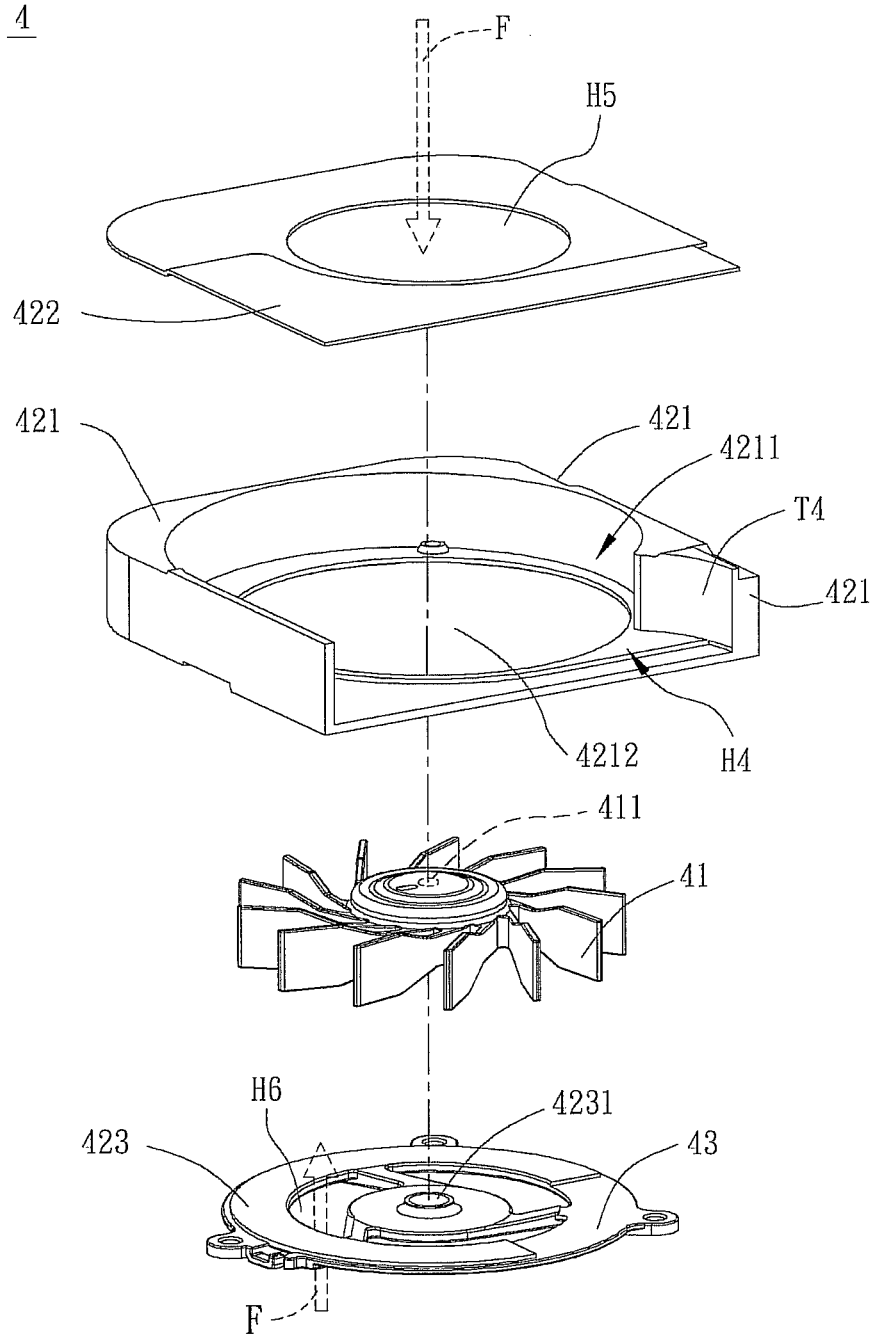
FIG. 9A is a exploded view of a blower according to a seventh embodiment of the present invention.

FIG. 9A is a schematic illustration of a blower according to a seventh embodiment of the present invention. Referring to FIG. 9A, the blower 4 has an impeller 41 and a housing 421.

Figure 9B:
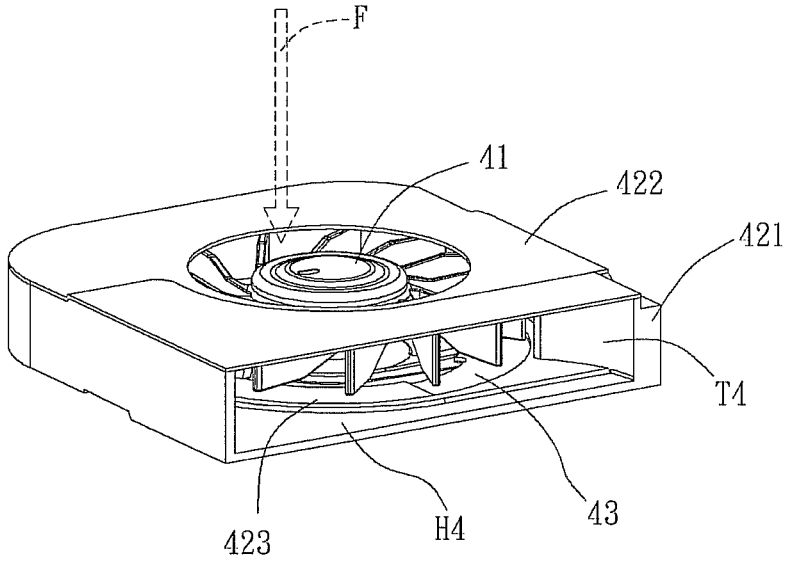
FIG. 9B is a schematic illustration showing the assembled blower of FIG. 9A.

The impeller 41 has a shaft 411. The housing 421 has an accommodating portion 4211, a central point 4231, a throat portion T4 and a concave portion 43. Besides, the blower 4 in this embodiment further has a cover 422, a base 423 and an outlet H4. As shown in FIG. 9B, the housing 421 and the cover 422 form the accommodating portion 4211. The throat portion T4 is formed on the housing 421. The b base 423 is used for supporting the impeller 41, and the bottom of the housing 421 has a through hole 4212 for combining with the base 423.

The cover 422 and the base 423 have an inlet H5 and an inlet H6, respectively. The central point 4231 and the concave portion 43 are both located on the base 423. The base 423 allows the installation of the impeller 41 before the connection with the housing 421. The concave portion 43 and the throat portion T4 thus fall in the first region as defined in the first embodiment (see FIG. 3B).

When the impeller 41 starts rotating, the airflow F enters the two inlets H5, H6. It is driven by the rotating impeller 41 to leave the housing 421 via the outlet H4. The use of the concave portion 43 can reduce the pressure in the vicinity of the throat portion due to the continuous airflow impact. Such effects have been elucidated in the above-mentioned embodiments, so the detailed descriptions are omitted.

In summary, the blower is provided with a throat portion located at concave portion of the housing. This design increases the air flowing space in the vicinity of the throat portion and guides the airflow direction, thereby reducing the pressure in the nearby region of the throat portion due to continuous impact of the airflow. The variations of airflow field and pressure gradient in the nearby region of the throat portion are decreased so that the blower of the present invention is free from large noises and high prominence ratios when impeller rotates.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. A blower, comprising:

an impeller having a shaft; and a housing having an outlet, a throat portion and a bottom, wherein the bottom has a main part and a concave part connected with the main part, the main part is higher than the concave part, the impeller is disposed within the housing, and the impeller rotates via the shaft, a first axial line and a second axial line are perpendicular to each other, and both intersect at a position where the shaft is located to divide the housing into four regions, and both of the throat portion and the concave part are disposed adjacent to the outlet and disposed in the first region of the four regions, wherein the concave part is disposed adjacent to the throat portion, wherein the throat portion has an inward arc toward to the first region, and the throat portion protrudes from a surface of the concave part.

2. The blower of claim 1, wherein the throat portion is located at the part portion of the housing.

3. The blower of claim 1, wherein the concave part has a slant surface.

4. The blower of claim 1, wherein the concave part has a plurality of concave sub-parts.

5. The blower of claim 1, wherein the main part is thicker than the concave part.

6. The blower of claim 1, wherein the blower further comprises a cover, and the outlet is formed when the cover is connected with the housing.

7. The blower of claim 6, wherein the blower has at least one first inlet, and an airflow direction at the outlet is perpendicular to an airflow direction at the first inlet.

8. The blower of claim 7, wherein the first inlet is disposed at the cover.

9. The blower of claim 1, wherein the housing further has a sidewall disposed around the bottom.

10. The blower of claim 9, wherein the blower has at least one second inlet disposed at the bottom of the housing.

11. The blower of claim 10, wherein the blower has at least two second inlets disposed at the bottom of the housing and surround around the position where the shaft is located.

12. The blower of claim 10, wherein the concave part and the second inlet are connected.

13. The blower of claim 10, wherein the concave part and the second inlet are disconnected.

14. The blower of claim 1, wherein a third axial line having a 45-degree angle rotation with respect to the first axial line divides a second region of the four regions adjacent to the first region into a first sub-region and a second sub-region.

15. The blower of claim 14, wherein the concave part is extended from the first region to at least one part of the first sub-region.

16. The blower of claim 1, wherein the concave part has a streamline shape.

17. The blower of claim 16, wherein the concave part further has a slant surface.

18. A blower, comprising:

an impeller having a shaft; and a housing having an outlet, a throat portion and a bottom, wherein the impeller is disposed within the housing, and the impeller rotates via the shaft, a first axial line and a second axial line are perpendicular to each other, and both intersect at a position where the shaft is located to divide the housing into four regions; and a base for supporting the impeller, wherein the base has a concave part and the bottom of the housing has a through hole for combining with the base, wherein both of the throat portion and the concave pat are disposed in the first region and adjacent to the outlet and disposed in the first region of the four regions, wherein the concave part is disposed adjacent to the throat portion, wherein the throat portion has an inward arc toward to the first region, and the throat portion protrudes from a surface of the concave part.

* * * * *